United States Patent [19]

Bennett

[11] 4,369,221

[45] Jan. 18, 1983

[54] PROTECTIVE COATING LAMINATE

[75] Inventor: Jack D. Bennett, Akron, Ohio

[73] Assignee: Transformer Service (Ohio), Inc., Akron, Ohio

[21] Appl. No.: 243,630

[22] Filed: Mar. 13, 1981

[51] Int. Cl.[3] ..... B05D 1/36; B32B 7/02; B32B 9/04; B32B 15/04

[52] U.S. Cl. ..... 428/216; 427/409; 428/334; 428/423.7; 428/467; 428/480; 428/497

[58] Field of Search ..... 428/216, 458, 425.8, 428/467, 450, 334, 335, 336, 423.7, 480, 497; 427/409

[56] References Cited

U.S. PATENT DOCUMENTS

| | | | |
|---|---|---|---|
| 3,598,659 | 8/1971 | Klingler et al. | 427/409 |
| 3,671,205 | 6/1972 | Uchida et al. | 427/409 |
| 4,165,242 | 8/1979 | Kelly et al. | 427/409 |
| 4,254,168 | 3/1981 | Monson | 427/409 |
| 4,298,635 | 11/1981 | Lovell | 427/409 |

*Primary Examiner*—William R. Dixon, Jr.

*Attorney, Agent, or Firm*—Oldham, Oldham, Hudak & Weber Co.

[57] ABSTRACT

A protective coating laminate and process for the application thereof contains a rust inhibitor layer which is applied to a metal substrate. A rust inhibitor-enamel layer resides thereon. An alkyd primer resides upon the rust inhibitor-enamel layer and in turn is covered by a polyurethane paint layer. The laminate is corrosive resistant and can be utilized to protect various items, for example, electrical equipment such as transformers, and the like.

7 Claims, 1 Drawing Figure

PROTECTIVE COATING LAMINATE

TECHNICAL FIELD

The present invention relates to a protective coating especially suitable for use in corrosive atmospheres or environments.

BACKGROUND ART

Heretofore, various protective paints, laminates, and the like have been used with only varying degree of success in protecting metals from rust, corrosion, oxidation, and the like. For example, primers have generally been applied to metal and then coated with a paint. However, depending upon the nature of the corrosive atmosphere, the paint would often last for only a few months before rust or corrosion of the metal occurred. Epoxy paints have also been used. However, in various corrosive atmospheres, in a period of from about four to about six months, the epoxy paint would start to peel or crack, followed by rusting or corrosion of the metal.

DISCLOSURE OF INVENTION

It is therefore an object of the present invention to provide a protective coating laminate for metals.

It is yet another object of the present invention to provide a protective coating laminate for metals, as above, which is easily and efficiently applied.

It is yet another object of the present invention to provide a protective coating laminate for metals, as above, wherein the laminate is applied entirely by spraying or by flow coating.

It is still another object of the present invention to provide a protective coating laminate for metals, as above, which is durable and long-lasting.

It is still another object of the present invention to provide a protective coating laminate for metals, as above, wherein an initial coating of a rust inhibitor is applied to the metal followed by a layer, a primer layer, with a urethane paint forming an outermost layer.

It is a still further object of the present invention to provide a protective coating laminate for metals, as above, wherein the rust inhibitor is a paint oil, wherein the enamel is an alkyd enamel, wherein the primer is an alkyd primer, and wherein the entire laminate is approximately 5 to 8 mils thick.

It is yet another object of the present invention to provide a protective coating laminate for metals, as above, wherein crack formation is readily prohibited.

These and other objects of the present invention will become apparent from the following specification.

In general, a protective coating laminate, comprises: a layer of a rust inhibitor; a rust inhibitor-enamel layer; an alkyd primer layer; and a polyurethane paint layer.

In general, a process for applying a protective coating to a metal, comprises the steps of: applying a rust inhibitor coating to the metal; applying a coating of a rust inhibitor-enamel mixture to said rust inhibitor coating; applying a coating of a primer to said rust-inhibitor-enamel coating; and applying a coating of the urethane paint to said primer coating.

BEST MODE FOR CARRYING OUT THE INVENTION

Figure 1:
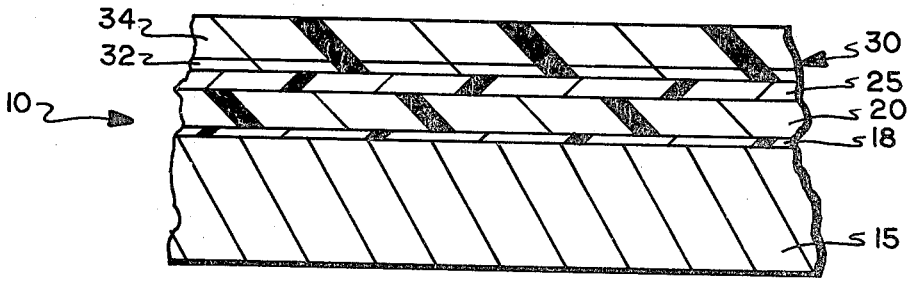
FIG. 1 is a cross-sectional view showing the various protective laminate layers applied to a metal.

A protective coating laminate according to the present invention is shown in FIG. 1 and is generally indicated by the numeral 10. The substrate which is coated is generally a metal 15, for example steel. The metal should be cleaned to remove all oils, greases, or previous paint coatings. Any conventional cleaning method may be utilized such as solvent application to remove greases and residue on bare metal or any conventional pressure blasting system to remove previous coatings of paint. For example, an existing paint layer can be removed by pressure blasting with sand, or a mixture of crushed corncob and limestone. The latter is preferred in removing rust, scale or paint from metal items which are thin such as transformer housings and other electrical equipment since sand will generally remove the metal and often cause holes therein.

A very thin layer or coating 18 of a rust inhibitor is applied to metal 15. Generally, any conventional rust inhibitor known to the art may be utilized. Desirably, the rust inhibitor contains a small amount of wetting agent so that it spreads across the metal surface and penetrates any rust or corrosive spots remaining after the cleaning job and prevents such rust or corrosion from further spreading. A specific type of rust inhibitor is a paint oil, preferably a high solids durability paint oil. A specific example is Penetrol manufactured by the Flood Company of Hudson, Ohio. The rust inhibitor thickness is from about 1/10 to about ½ mil in thickness, with about ⅛ mil being preferred. Although application of the rust inhibitor may be carried out in any conventional manner, spraying is preferred.

A rust inhibitor-enamel layer 20 is then applied. The layer is a mixture of a conventional rust inhibitor, as set forth above, and an alkyd enamel. The amount of rust inhibitor by volume, based upon the total volume of the rust inhibitor-enamel solution is from about 15 to about 60 percent, desirably from about 20 to about 45 percent, and preferably approximately 30 percent, that is from about 25 to about 35 percent. A suitable alkyd enamel is Metalastic II, manufactured by Sherwin-Williams Company, Cleveland, Ohio. Metalastic II contains approximately 45 percent by weight of various solvents such as mineral spirits. The rust inhibitor-enamel layer 20 is applied in any suitable manner as by brushing, or preferably as by spraying until a thickness of from about 0.5 to about 3 mils, and preferably from about 1 to about 2 mils is achieved. The rust inhibitor layer 20 seals the metal and any cracks therein as well as rust inhibitor layer 18.

To layer 20 is applied a barrier primer coating 25 which prevents the outer coatings from attaching rust inhibitor-enamel layer 20. Generally, any conventional alkyd primer (oil-based paint) can be utilized. An example of a specific primer is KEM-FLASH manufactured by the Sherwin-Williams Company of Cleveland, Ohio. The primer may have any amount of solvent therein, typically about 40 percent. The primary solvent can naphtha (that is about 30 percent) with minor amounts (that is 3 to 5 percent) of mineral spirits and toluene. Although the alkyd primer may be applied to rust inhibitor-enamel coating 20 in any conventional manner, spraying is desired. Generally, the alkyd primer is reduced with an amount of solvent of from about 20 percent to about 60 percent by volume and preferably about 30 percent, that is from about 25 to about 35 percent based upon the total volume of the primer and the solvent. The reducer can contain solvents on a weight basis, such as approximately 55 percent of mineral spirits, 15 percent of toluene, 15 percent of isobutyl acetate, 5 percent of isopropyl alcohol, 5 percent of xylene, and about ½ percent of methyl ethyl ketone. Such a specific reducer is available as Exempt T from the Sherwin-Williams Company. Alternatively, another solvent system, Exempt X may be utilized. The thickness of the primer coating will generally range from about ½ to about 3 mils, with from about 1 to about 2 mils being preferred.

Layer 30 is a polyurethane base paint and is generally applied by spraying or by flow coating. The polyurethane paint in being the outer layer affords good protection to the paint laminate in that it is highly resistant to corrosion, various chemical agents, and the like which generally might be found in the environment or in the atmosphere, or an industrial plant, a chemical plant, etc. The polyurethane utilized is a fully catalyzed polyurethane having a catalytic cure (that is, crosslinks) at temperatures above 32° F. In other words, the urethane is not moisture cured. A specific example of a fully catalyzed polyurethane paint is Polane Hs manufactured by the Sherwin-Williams Company. Desirably the urethane paint is applied in two layers, the first layer being a thin or tack layer which bonds to the primer layer and prevents runs in the finish coat. A thick or finishing coat is then applied. Tack layer 32 generally is about 1 mil in thickness with the final layer being about 2 mils. The overall thickness of the polyurethane paint is from about 1 to about 4 mils with from 2 to about 3 mils being preferred.

The protective coating of the present invention can be utilized in any situation wherein a protective, corrosion resistant coating is desired. It is especially desirable for use on apparatus in environments wherein a corrosive atmosphere exists such as chemical plants, industrial plants, and the like. A specific use is in the coating or protection of electrical equipment such as transformers, sub-stations and the like. It is also very suitable for use on items wherein a long term paint application is desired without peeling, cracking, blistering, etc., since the laminate is resistant to such.

The invention will be better understood by reference to the following example.

EXAMPLE

A transformer was thoroughly cleaned by pressure blasting with crushed corncob and limestone to remove the old paint, including rust and scale. After the unit was completely cleaned, approximately a ⅛ mil layer of a rust inhibitor (Penetrol) was applied to the transformer utilizing conventional spray equipment. Then, a mixture containing by volume, 30 percent Penetrol and 70 percent of an alkyd enamel, Metalastic II, applied by spraying until about a 2 mil thickness was achieved. An alkyd primer, CHEM-FLASH, reduced with a 30 percent volume of a solvent, Exempt X, was sprayed over the rust inhibitor-enamel coating. The primer coating thickness was approximately 2 mils. Then a slight tack coat of a fully catalyzed polyurethane paint, Polane Hs, was sprayed over the primer coating to a thickness of about 1 mil. After the polyurethane coating was tacky, a finishing coating of Polane Hs was applied in a thickness of approximately 2 mils. The entire thickness of the protective coating was about 7 mils.

The above protective laminate which was sprayed utilizing conventional standard equipment has now been in use for approximately nine months in a corrosive environment and yet shows no signs of cracking or peeling. Prior epoxy paints have lasted only from about four to six months, whereupon chalking and cracking occurred, along with ensuing corrosion of the metal.

Accordingly, the laminate of the present invention constitutes an unexpected improvement in protecting various metals.

Having described the invention and the best mode, in accordance with the patent statutes, the invention is measured by reference to the attached claims.

What is claimed is:

1. A protective coating laminate, for a metal substitute comprising: a metal substrate having thereon
- a layer of a paint oil rust inhibitor;
- a rust inhibitor-alkyd enamel layer;
- an alkyd primer layer; and
- a polyurethane paint layer;
- wherein said rust inhibiting layer range from about 1/10 mil to about ½ mil, wherein said rust inhibitor-enamel layer ranges from about 0.5 to about 3 mils, wherein said primer layer ranges from about 0.5 to about 3 mils, and wherein said urethane layer ranges from about 1 to about 4 mils in thickness.

2. A protective coating laminate according to claim 1, wherein said rust inhibitor is a high solids durable paint oil, wherein said polyurethane paint is a fully catalyzed paint.

3. A protective coating laminate according to claim 2, wherein said polyurethane layer exists as two layers, and wherein rust inhibitor-enamel layer is applied from a rust inhibitor-enamel mixture containing from about 15 to about 60 percent by volume of said rust inhibitor.

4. A protective coating laminate according to claim 3, wherein said rust inhibitor layer is about ⅛ mil, wherein said rust inhibitor-enamel layer ranges from about 1 to about 2 mils, wherein said primer layer ranges from about 1 to about 2 mils, and wherein said urethane layer ranges from about 2 to about 3 mils in thickness.

5. A process for applying a protective coating to a metal, comprising the steps of:
- applying a paint oil rust inhibitor coating to the metal;
- applying a coating of a paint oil rust inhibitor-alkyd enamel mixture to said rust inhibitor coating;
- applying a coating of an alkyd primer to said rust inhibitor-enamel coating; and
- applying a coating of a fully catalyzed polyurethane paint to said primer coating;
- wherein the thickness of said rust inhibitor coating ranges from about 1/10 to about ½ mil wherein the thickness of said rust inhibitor-enamel coating ranges from about 0.5 to about 3 mils, wherein the thickness of said primer coating ranges from about 0.5 to about 3 mils, and wherein the thickness of said urethane coating ranges from about 1 to about 4 mils.

6. A process according to claim 5, wherein the amount of rust inhibitor in said rust inhibitor-enamel mixture ranges from about 15 percent to about 60 percent by volume, and reducing said primer with from about 20 percent to about 60 percent by volume of a solvent based upon the total volume of said primer and said solvent, and applying said urethane coating in two separate coats.

7. A process according to claim 1, wherein the thickness of said rust inhibitor is about ⅛ mil, wherein the thickness of said rust inhibitor-enamel coating ranges from about 1 to about 2 mils, wherein the thickness of said primer coating ranges from about 1 to about 2 mils, and wherein the thickness of said urethane coating ranges from about 2 to about 3 mils.

* * * * *